United States Patent [19]

Engelhart

[11] Patent Number: 4,603,521

[45] Date of Patent: Aug. 5, 1986

[54] SWIMMING POOL COPING AND CLIP

[75] Inventor: Jack Engelhart, Clio, Mich.

[73] Assignee: Quality Pool Mfg. Co., Clio, Mich.

[21] Appl. No.: 548,458

[22] Filed: Nov. 3, 1983

[51] Int. Cl.[4] ..... E02D 27/00

[52] U.S. Cl. ..... 52/102; 52/169.7; 52/631; 4/506

[58] Field of Search ..... 52/102, 169.1, 169.7, 52/300, 658, 631; 4/506; 264/399

[56] References Cited

U.S. PATENT DOCUMENTS

| | | | |
|---|---|---|---|
| 2,781,111 | 2/1957 | Kunkel | 52/658 |
| 4,004,386 | 1/1977 | Diffenderfer | 52/169.7 |
| 4,255,914 | 3/1981 | Seipos | 52/714 |
| 4,432,173 | 2/1984 | Kleinert | 52/169.7 |
| 4,457,119 | 7/1984 | Dahowski | 52/300 |

FOREIGN PATENT DOCUMENTS

| | | | |
|---|---|---|---|
| 456178 | 11/1936 | United Kingdom | 52/658 |

*Primary Examiner*—Henry E. Raduazo

*Attorney, Agent, or Firm*—Gifford, Groh, VanOphem, Sheridan, Sprinkle & Dolgorukov

[57] ABSTRACT

A pool coping system comprises a plurality of straight and curvable pool coping pieces. Each piece bears an opposing flange and groove thereon, which are alignable with the flange and groove on adjacent coping pieces. The pieces are joined by the insertion of an h-shaped clip into the adjacent coping pieces. The pool coping pieces comprise outward and inward piece portions. On only the foldable coping piece, the inward portion bears at least one V-shaped notch therein, with a corresponding number of relief cuts disposed in the outward piece portion opposite the at least one notch. A somewhat coplanar wall and flange are carried on the outward and inward piece portions, respectively. The invention includes the h-shaped clip, having two parallely disposed and longitudinally extending planar members. One of these members is narrower than the other, and is joined to the wider member by a somewhat perpendicularly disposed clip wall.

15 Claims, 4 Drawing Figures

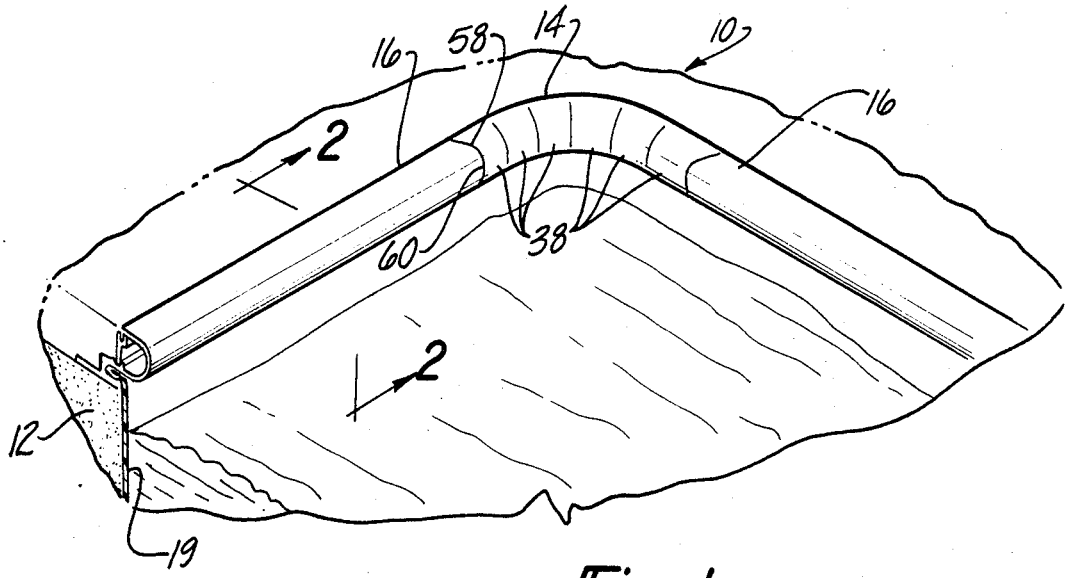
Fig-1
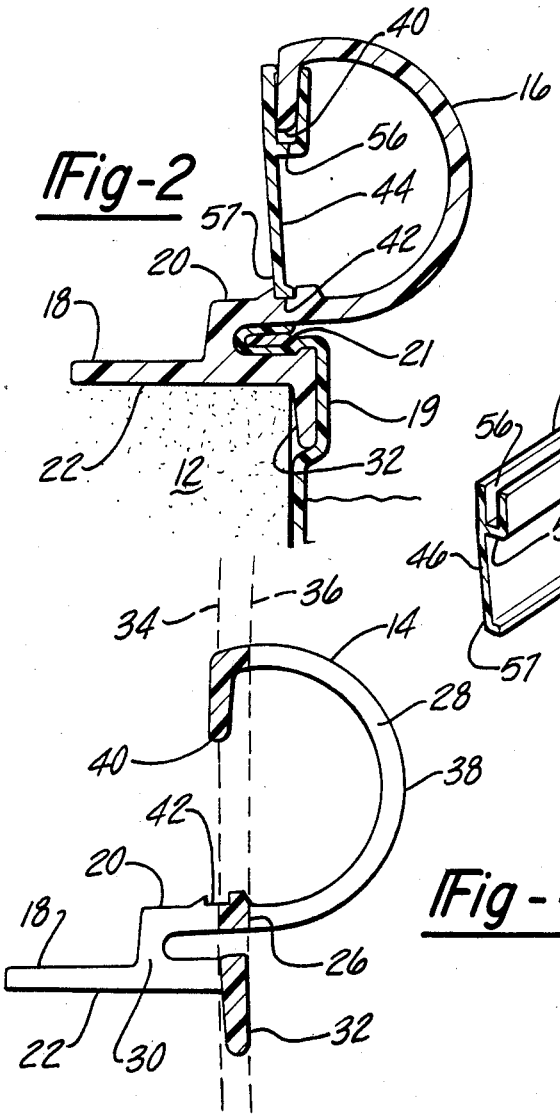
Fig-2
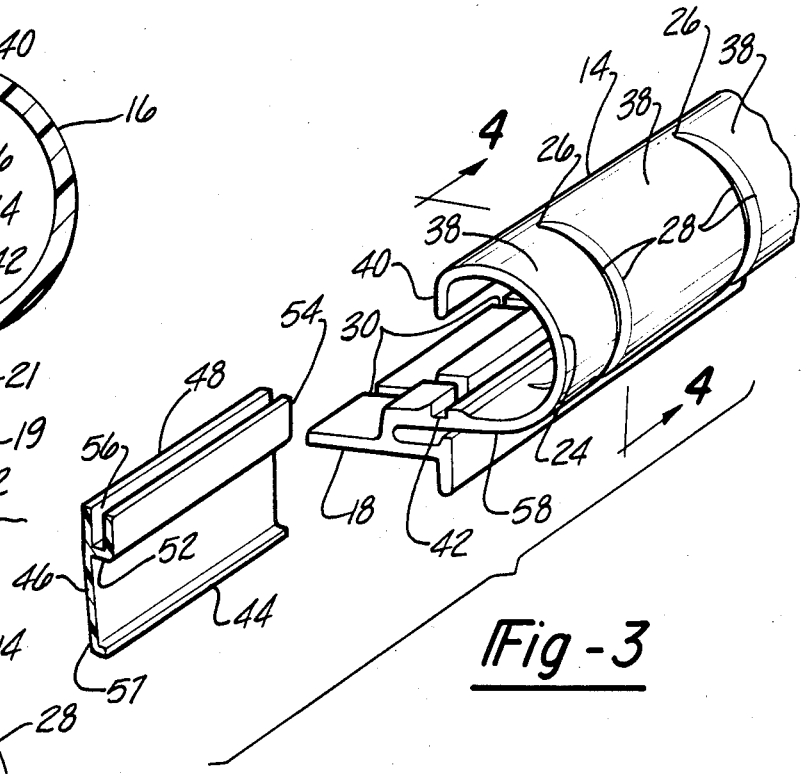
Fig-3
Fig-4

SWIMMING POOL COPING AND CLIP

BACKGROUND OF THE INVENTION

I. Field of the Invention

The present invention is directed to an appurtenance for swimming pools, and more particularly, to a coping assembly for the edge of a swimming pool wall.

II. Description of the Prior Art

It has long been known to apply a coping or edging to the corner of a pool wall. A pool coping provides a hard and attractive frame on which the bather may stand and which may be used to aid in the entry to and exit from the pool. It can also serve to cover any sharp edge or corner of the pool wall and prevent injury to the bather that might arise from contact with that edge.

Swimming pool copings formed from curved, extruded members are known in the art; for example, as in U.S. Pat. No. 3,524,291 to Rozanski. Other pool copings, such as that disclosed by Greene in U.S. Pat. Nos. 3,512,326 and 3,785,099 include a plurality of coping pieces which interlock with a framing member and each other.

However, these and other known swimming pool coping structures share several disadvantages. Swimming pool copings which comprise a large multiplicity of short coping segments require a substantial amount of time to be installed. Unless the distance to be traversed by the pool coping happens to be equal to an even multiple of the length of the coping pieces, at least one coping piece will have to be cut to a particular length, different from the length of the other pieces. This gives a nonuniform and unattractive appearance to the pool coping. Moreover, many of the known pool coping system incorporate a rather complex interlock system or framing substructure, which increases both the cost of providing the coping and the difficulty of installing it. Finally, many known pool coping systems require a special corner piece to be applied at the juncture of the pool walls. This piece must often be molded or formed in a manner substantially different from the straight segments of pool coping. Such corner pieces are often oddly shaped and cannot be packed in as convenient a fashion as are the straight coping pieces.

SUMMARY OF THE PRESENT INVENTION

The present invention overcomes these and other difficulties by providing a pool coping system of simple design and adapted for easy installation, yet which is also easy to ship and can yield a uniform appearance. In the preferred embodiment of the present invention, the pool coping system comprises a plurality of pool coping pieces which are abuttably engagable with the pool wall. Adjacent coping pieces are joined to one another by an insertable clip, having a flange and a groove thereon, which are engagable with alignable flanges and grooves upon adjacent coping pieces.

Each coping piece comprises an inward portion of substantially semicylindrical shape, and an outward portion engagable with the pool wall. Both straight segments and corner pieces have the same general cross-sectional configuration. However, the corner pieces additionally bear a plurality of notches in their inward portions, and a matching plurality of opposing relief cuts in their outer portions. At least the corner pieces are at least somewhat deformable, so that the corner pieces are bendable or foldable to fit the corners where adjacent pool walls meet. Preferably, the coping pieces comprise an extruded plastic material. The straight segments can be extruded in the same fashion as the corner coping pieces; preferably, the corner pieces are formed by making the cuts and notches in a straight coping segment. The corner pieces can thus be shipped and treated prior to installation in the same fashion as the straight pieces, and do not require the shipping space that would be required by a preformed corner piece of the same radius.

The insertable pool coping clip of the present invention is somewhat elongated and has an h-shaped cross section. The clip comprises an elongated planar first member, a wall attached to the first member, and an elongated planar second member extending from the wall and outward towards a longitudinal edge of the first member. The portion of the first member opposite this longitudinal edge forms the clip flange, and the clip groove is formed between the first and second members.

The pool coping system thus provided is easy to install, yet is adaptable to any size of pool. The coping pieces are relatively inexpensive to both construct and ship, lowering the cost of providing an attractive coping on the edge of a pool wall.

BRIEF DESCRIPTION OF THE DRAWING

A better understanding of the present invention will be had upon reference to the following detailed description, when read in conjunction with the accompanying drawing, wherein like reference characters refer to like parts throughout the several views and in which:

FIG. 1 is a perspective view of the preferred embodiment of the present invention;

FIG. 2 is a cross-sectional view taken along line 2—2 of FIG. 1;

FIG. 3 is a partial exploded view of the preferred embodiment of the present invention; and FIG. 4 is a cross-sectional view taken at the location of a notch and opposing relief cut along the line 4—4 of FIG. 3.

DETAILED DESCRIPTION OF THE PREFERRED EMBODIMENT OF THE PRESENT INVENTION

With reference now to FIG. 1, a coping system 10 according to the present invention is thereshown disposed upon a pool wall 12. The coping system 10 first comprises a plurality of corner coping pieces 14 and straight coping pieces 16 joined to one another.

As best shown in FIG. 2, each of the corner coping pieces 14 and the straight coping pieces 16 first comprises an outward piece portion 18 which is abuttable against the pool wall 12. The outward piece 18 is somewhat h-shaped and comprises an upper L-shaped leg 20, and a lower, somewhat planar leg 22. Preferably, the outward piece portion 18 is adapted to be engaged with a pool liner 19, by the engagement of the pool liner 19 and insertable retainer 21 between the L-shaped leg 20 and the somewhat planar leg 22.

Each of the coping pieces 14 and 16 also comprises an inward piece portion 24 attached to the outward piece portion 18. Preferably, the inward piece portion 24 is semicylindrical in cross section, although other shapes are usable as well. On only the corner coping pieces 14 (FIGS. 3 and 4), at least one notch 26 is formed in the inward piece portion 24. Each notch 26 is V-shaped from a vertical perspective and comprises a pair of opposing but abuttable edges 28. Also on each of only the corner coping pieces 14, a relief cut 30 is provided in the outward piece portion 18 disposed opposite each of the notches 26 in the inward piece portion 24.

Each of the coping pieces 14 and 16 additionally comprises a longitudinally extending wall 32 somewhat perpendicularly attached to the outward piece portion 18 at the inward end of the planar leg 22. The wall 32 serves to align the coping piece 14 or 16 on the pool wall 12. As shown in FIGS. 2 and 4, the wall 32 is disposed generally between the vertical extent of the outward piece portion 18 and the inward piece portion 24.

Preferably, the wall 32 defines an outer vertical plane 34 and an inner vertical plane 36. Each of the relief cuts 30 extends generally to the outer vertical plane 34, and each of the notches 26 extends generally to the vertical plane 36, on the corner coping piece 14.

The notches 26 serve to separate the corner coping piece 14 into a plurality of semicylindrical segments 38, which are disposed parallel to the wall 32. These segments 38 are joined to one another at their top edge by a vertically depending flange 40. The straight coping pieces 16 are provided with a similarly positioned flange 40 as well. The flange 40 extends along the length of the coping piece 14 or 16, and is disposed somewhat between the outer vertical plane 34 and the inner vertical plane 36 defined by the wall 32.

Preferably, then, except for the provision of the notches 26 and relief cuts 30 therein, the corner coping pieces 14 are identical in cross section to the straight coping pieces 16.

On each of the coping pieces 14 or 16, a coping groove 42 is formed in the coping piece 14 or 16 opposite the depending flange 40. The coping groove 42 and the flange 40 on adjacent coping pieces are adapted to be engagable with an h-shaped clip 44 (FIGS. 2 and 3). The clip 44 comprises a first elongated and substantially planar member 46 having a longitudinal edge 48. The clip 44 also comprises a wall 52 attached substantially perpendicularly to the first member 46. A second elongated and substantially planar member 54 depends substantially perpendicularly from the wall 52, extending opposite the first member 46 from the wall 52 substantially to the longitudinal edge 48. The second member 54 is thereby disposed substantially parallel to the first member 46.

The first member 46, the wall 52 and the second member 54 thus define a clip groove 56 adapted to receive the depending flange 40 therein (FIG. 2). The portion of the first member 46 which is not opposite the second member 54 defines a clip flange 57 which is adapted to engage the coping groove 42 in the coping piece 14 or 16. Alternatively, the clip 44 and the coping pieces 14 and 16 can bear a multiplicity of corresponding flanges and grooves.

The use of the present invention, by the assembly of corner coping pieces 14, straight coping pieces 16 and clips 44 into the coping system 10, is straightforward. A key to the construction of the coping system 10 is the construction of the corner coping pieces 14 out of a material which is sufficiently deformable to permit the folding of each piece 14 at its notches 26 and relief cuts 30. At least the corner coping pieces 14 are formed from a material which is sufficiently deformable to permit the piece 14 to be folded by abutting the opposing edges 28 of each notch 26. This material should be sufficiently flexible so as not to break when deformed in this manner. Preferably, at least the corner pieces 14 are constructed from extruded plastic, such as PVC plastic. However, aluminum pool coping can also be provided with the notches 26 and relief cuts 30 disclosed herein.

In constructing the system 10, as shown in FIG. 1, one of the corner coping pieces 14 is appropriately folded and abutted against the pool wall 12 at a corner thereof. The coping is then affixed to the pool wall 12 in any fashion known in the art. One of the clips 44 is then inserted into an end 58 of the corner piece 14 by sliding the clip flange 57 in the coping groove 42, and the clip groove 56 along the depending flange 40. The free end of the clip 44 is inserted into an adjacent end 60 of another coping piece, preferably on the adjacent end 60 of the adjacent straight piece 16. The piece 16 and the clip 44 are slid until the adjacent ends 58 and 60 of the corner piece 14 and the straight piece 16, respectively, abut against one another. The straight coping 16 is then affixed to the pool wall 12 in a conventional fashion. In this way, the coping groove 42 and the flange 40 on each of the corner coping pieces 14 and the straight coping pieces 16 are aligned with one another.

Alternatively, if the coping pieces 14 and 16 are sufficiently elastic, their coping grooves 42 and flanges 40 may be otherwise aligned (for example, by abutment of each piece 14 or 16 against the pool wall 12), and the clip 44 pushed transversely into engagement therewith.

A curved pool corner having the smoothest appearance will be achieved when the notches 26 (and the corresponding relief cuts 30) are greater than one in number, and the notches 26 are equally angled and equally spaced from one another. For example, in the preferred embodiment herein described, the notches are five in number, and each have an angle less than or equal to 18 degrees. In theory, the angle of each notch 26 should be equal to the angle through which the coping piece is to be folded, divided by the number of notches 26 to be provided. However, depending upon the nature of the material employed to construct the corner coping piece 14, or to be able to use the coping in situations where the corner of the pool has not been properly angled or evenly radiused, it may be desirable to employ a notch angle slightly less than that which should be used in theory. This will allow the individual user to remove material from the notch edges 28 if a more acute folding angle is required. When the coping piece 14 is constructed from plastic, the use of a notch angle slightly smaller than theoretical will permit a firm abuttment of the adjacent notch edges 28 and fill any gaps therebetween, since the plastic notch edges 28 should deform slightly upon such abuttment.

The modular pool coping system of the present invention preferably comprises a multiplicity of the coping pieces, 14 or 16, with a sufficient number of clips 44 to engage and join the adjacently disposed coping pieces. The modular system is, of course, usable with coping pieces other than as described herein. In particular, a rigid or continuous corner coping piece can be joined to a straight coping piece 16 in the same fashion as a foldable corner coping piece 14. In simplest form the modular system comprises a multiplicity of coping pieces configured to be joined by an insertable clip, preferably the clip 44 as herein described.

A corner coping piece 14 can be provided with more than one set of the notches 26 and the corresponding relief cuts 30. For example, the corner piece could be bent through a 180 degree angle, with a straight section of coping integrally disposed between two sets of corner notches 26 and relief cuts 30 as previously described. Alternatively, the pool coping system can comprise only a single pool coping piece, whose opposing ends are joinable by a single clip. The coping notches 26 and relief cuts 30 would be disposed along the entire length of the single coping piece. In the case of a circular pool wall, the notches 26 and cuts 30 would be equally disposed, with the notches 26 being cut at the previously described angle.

Having described my invention, however, many modifications thereto will become apparent to one skilled in the art to which it pertains without deviation from the spirit of the invention as defined by the scope of the appended claims.

I claim:

1. A swimming pool coping for use on a swimming pool which includes a pool wall face, said coping comprising at least one somewhat resilient foldable coping piece comprising:

an inward piece portion lying generally inward of a first vertical plane substantially contiguous to said pool wall face; an outward piece portion lying generally outward of said first vertical plane; means forming at least one notch in said inward piece portion; and means forming a corresponding number of relief cuts in said outward piece portion, one each opposite each of said notches; wherein said piece is sufficiently deformable to permit the folding of said piece at each of said at least one notch and said corresponding cut;

wherein said coping piece further comprises a longitudinally extending wall portion attached to said outward piece portion and substantially contiguous to said pool wall face;

wherein said inward piece portion comprises a plurality of semi-cylindrical segments disposed parallel to said longitudinally extending wall portion;

wherein said coping piece further comprises a longitudinally extending flange disposed somewhat coplanar with said longitudinally extending wall portion, joining said segments;

wherein said coping piece comprises means forming an upwardly facing groove therein between said inward and outward piece portions, disposed substantially near said first vertical plane, and wherein said flange extends downwardly towards said groove means; and wherein said coping comprises a plurality of abuttable coping piece ends, and at least one clip slidably engageable with adjacently disposed coping piece ends so as to simultaneously splice said abutting coping piece ends together and align said upwardly facing groove means and said downwardly extending flanges on said abutting piece ends.

2. The invention according to claim 1, wherein said coping piece is constructed of extruded plastic.

3. The invention according to claim 1, wherein said coping piece is substantially rigid.

4. The invention according to claim 1, wherein said at least one notch is five in number.

5. The invention according to claim 1, wherein said notch is V-shaped in cross section and has two abuttable edges, said edges adapted to come into abutment upon said folding of said piece.

6. The invention according to claim 1, wherein said notches and relief cuts are greater than two in number and are equally spaced, and said notches are equally angled.

7. The invention according to claim 1, wherein the angle of each of said at least one notch is less than or equal to the ratio of the angle through which said piece is to fold to the number of said at least one notch.

8. The invention according to claim 1, wherein said clip is rigid.

9. The invention according to claim 1, wherein said clip is constructed of plastic.

10. The invention according to claim 1, wherein said longitudinally extending wall portion comprises a vertical surface spaced from said pool wall face, wherein said notch means extends approximately to a second vertical plane substantially contiguous to said vertical surface, and wherein said relief cut means extends approximately to said first vertical plane.

11. The invention according to claim 1, wherein said outward piece portion comprises a horizontal, somewhat planar lower leg, and an upper L-shaped leg perpendicularly attached to said lower leg and connected to said inward piece portion.

12. The invention according to claim 11, wherein said longitudinally extending wall portion extends perpendicularly downwardly from said lower planar leg of said outward piece portion.

13. A swimming pool coping for use on a swimming pool which includes a pool wall face, said coping comprising at least one somewhat resilient foldable coping piece comprising:

an inward piece portion lying generally inward of a first vertical plane substantially contiguous to said pool wall face; and outward piece portion lying generally outward of said first vertical plane; means forming at least one notch in said inward piece portion; and means forming a corresponding number of relief cuts in said outward piece portion, one each opposite each of said notches; wherein said piece is sufficiently deformable to permit the folding of said piece at each of said at least one notch and said corresponding cut;

wherein said coping piece further comprises a longitudinally extending wall portion attached to said outward piece portion and substantially contiguous to said pool wall face;

wherein said inward piece portion comprises a plurality of semi-cylindrical segments disposed parallel to said longitudinally extending wall portion;

wherein said coping piece further comprises a longitudinally extending flange disposed somewhat coplanar with said longitudinally extending wall portion, joining said segments;

wherein said coping piece comprises means forming an upwardly facing groove therein between said inward and outward piece portions, disposed substantially near said first vertical plane, and wherein said flange extends downwardly towards said groove means;

wherein said coping comprises a plurality of abuttable coping piece ends, and at least one clip slidably engageable with adjacently disposed coping piece ends; and wherein said clip comprises a clip flange, and means forming a clip groove spaced from said clip flange, said clip being dimensioned such that said clip is both transversely and longitudinally engageable with said coping piece, said clip flange engaging said coping piece groove means and said longitudinally extending flange on said piece engaging said clip groove means.

14. The invention according to claim 13, wherein said clip is h-shaped.

15. The invention according to claim 13, wherein said clip consists essentially of:

an elongated planar first member, having first and second longitudinal edges spaced apart by a distance about equal to the interior diameter of said semi-cylindrical segment; a clip wall member attached substantially perpendicularly to said first member, between and parallel to said longitudinal edges, and having a height greater than the thickness of said longitudinally extending flange on said outer coping piece portion; and an elongated planar second member, laterally narrower than said first member, and attached to said clip wall member opposite but substantially parallel to said first member, extending outwardly from said clip wall member substantially to said first longitudinal edge of said first member; wherein said first member is dimensioned at said second edge so as to be engageable with said groove means on said coping piece.

* * * * *

UNITED STATES PATENT AND TRADEMARK OFFICE

CERTIFICATE OF CORRECTION

PATENT NO. : 4,603,521
DATED : August 5, 1986
INVENTOR(S) : JACK ENGELHART

It is certified that error appears in the above-identified patent and that said Letters Patent are hereby corrected as shown below:

Column 8, line 2, claim 15, delete "outer".

Signed and Sealed this

Third Day of March, 1987

*Attest:*

DONALD J. QUIGG

*Attesting Officer*

*Commissioner of Patents and Trademarks*